United States Patent [19]

Klüttermann

[11] Patent Number: 4,679,279

[45] Date of Patent: Jul. 14, 1987

[54] SLIVER COILER

[75] Inventor: Jürgen Klüttermann, Mönchengladbach, Fed. Rep. of Germany

[73] Assignee: Trützschler GmbH & Co. KG, Mönchengladbach, Fed. Rep. of Germany

[21] Appl. No.: 862,245

[22] Filed: May 12, 1986

[30] Foreign Application Priority Data

May 11, 1985 [DE] Fed. Rep. of Germany ..... 3517060

[51] Int. Cl.[4] ..... B65H 54/80

[52] U.S. Cl. ..... 19/159 R

[58] Field of Search ..... 19/159 R

[56] References Cited

U.S. PATENT DOCUMENTS

| | | | |
|---|---|---|---|
| 2,842,805 | 7/1958 | Kaiser | 19/159 R |
| 2,897,550 | 8/1959 | Carmichael et al. | 19/159 R |
| 4,495,677 | 1/1985 | Rosink | 19/159 R |

FOREIGN PATENT DOCUMENTS

| | | | |
|---|---|---|---|
| 1859997 | 7/1962 | Fed. Rep. of Germany . | |
| 1510339 | 11/1969 | Fed. Rep. of Germany . | |
| 1510248 | 1/1974 | Fed. Rep. of Germany . | |
| 2353889 | 5/1975 | Fed. Rep. of Germany . | |
| 2721422 | 11/1978 | Fed. Rep. of Germany . | |
| 1075831 | 4/1954 | France | 19/159 R |
| 1065979 | 4/1967 | United Kingdom | 19/159 R |
| 1507509 | 4/1978 | United Kingdom . | |

*Primary Examiner*—Louis K. Rimrodt

*Attorney, Agent, or Firm*—Spencer & Frank

[57] ABSTRACT

A sliver coiler includes a rotary head assembly, a sliver trumpet eccentrically mounted in the rotary head assembly and a sliver guide element situated generally centrally above the rotary head assembly at a distance therefrom, whereby the sliver has an unsupported running portion from the sliver guide element to the sliver trumpet. The angle formed between the plane of rotation of the rotary head assembly and a line connecting the sliver guide element with the sliver trumpet is 30° at the most.

12 Claims, 7 Drawing Figures

Fig. 2a
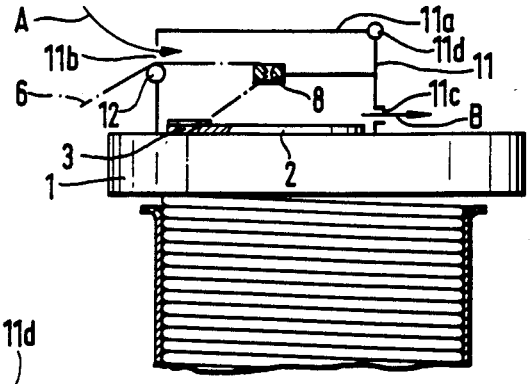
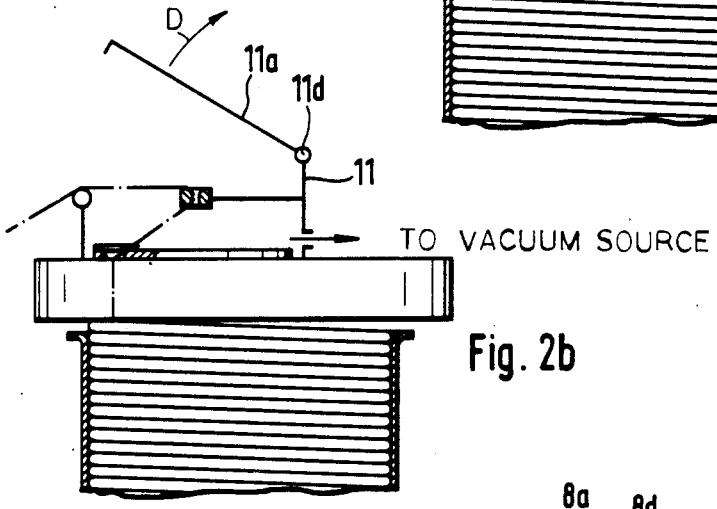
Fig. 2b
Fig. 3
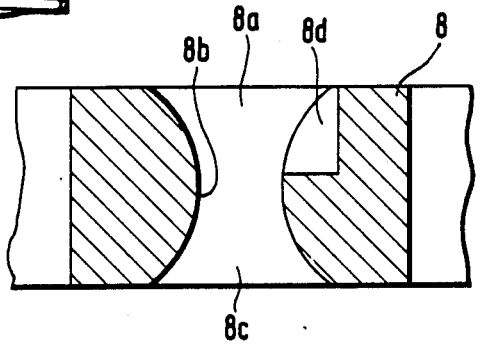
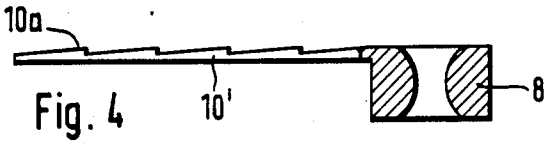
Fig. 4

SLIVER COILER

BACKGROUND OF THE INVENTION

This invention relates to a sliver coiler including a support arrangement for positioning the running sliver as it is delivered by a carding machine, a rotary head assembly including an orbiting sliver trumpet through which the sliver passes as it runs from the support arrangement; and calender rollers arranged underneath the sliver trumpet and orbiting therewith. After the sliver passes through the calender rollers, it is deposited in continuous coils into a rotating coiler can disposed underneath the rotary head assembly.

In a known apparatus the sliver supporting arrangement includes a sliver deflecting roller which is situated above the rotary head assembly and which rotates about an approximately horizontal axis. The distance between the sliver deflecting roller and the rotary head assembly is greater than the radius of the rotary head assembly, and the angle of the connecting line between the trumpet and the roller to the (generally horizontal) plane in which the head asssembly rotates is approximately 70°. In such an arrangement, at high sliver speeds of, for example, more than 300 m/min, the risks are high that the unsupported sliver significantly bulges outwardly under the effect of centrifugal forces and may rupture.

SUMMARY OF THE INVENTION

It is an object of the invention to provide an improved apparatus of the above-outlined type from which the discussed disadvantage is eliminated and which thus may operate at high speeds without the risks of disturbances, such as sliver rupture.

This object and others to become apparent as the specification progresses, are accomplished by the invention, according to which, briefly stated, the angle of a line connecting a sliver supporting arrangement above the rotary head assembly and the sliver trumpet mounted in the rotary head assembly, forms a maximum angle of 45° with the plane in which the rotary head assembly rotates.

It is a significant characteristic of the apparatus according to the invention that the sliver running from the deflecting (sliver supporting) arrangement above the rotary head assembly to the sliver trumpet forms a small (flat) angle with the generally horizontal plane in which the rotary head assembly revolves. In this manner the magnitude of the centrifugal force component which causes an outward bulging of the free length portion of the sliver between the supporting (deflecting) arrangement and the sliver trumpet is significantly reduced. As a result, significantly higher operational speeds are possible (in excess of 300 m/min) without rupture of the sliver. Also, a higher output of the sliver coiler is ensured.

According to a further feature of the invention, the distance between the sliver supporting arrangement and the rotary head assembly is equal to or is smaller than the radius of the rotary head assembly. Such an arrangement ensures that the angle $\alpha$ will have the small value according to the invention.

According to a further feature of the invention, the sliver supporting arrangement is constituted by a trumpet-like guide element which functions as a predensifier. As the sliver passes through the trumpet-like guide element, air is pressed out of the sliver, thus reducing the diameter of the sliver and rendering it more stable and less prone to rupture.

According to a further feature of the invention, the guide element has, in its wall, at least one recess through which air flowing in the reverse direction due to the precompression in the trumpet-like guide element is removed.

In accordance with a further feature of the invention, upstream of the guide element - as viewed in the direction of sliver run - there is provided at least one further sliver support which is preferably constituted by a trough in which the sliver is guided to the deflecting support arrangement while shielding the sliver from interfering lateral air streams.

According to still another feature of the invention, the second sliver support is a backup plate which has at least a zonewise shingle-like (stepped) configuration. Such a construction causes the sliver to glide on an air cushion as it travels on the backup plate.

According to another feature of the invention, a hood is provided which extends over one part of the sliver coiler, whereby the sliver is screened from interfering air streams. Expediently, the guide element is situated underneath the hood, whereby interfering air streams are screened from the zones of the sliver upstream of the guide element as well as between the guide element and the sliver trumpet.

In accordance with a further feature of the invention, a suction device is connected with the hood to remove dust and other released waste.

According to still another feature of the invention, the upper part of the hood is pivotal to provide for an easy manual access underneath the hood, particularly for the purpose of facilitating the start-up, by introducing the sliver manually into the sliver trumpet.

According to another advantageous feature of the invention, inside the hood, about the rotary head assembly, there is provided a circularly bent shielding element which prevents dust and similar waste from accumulating in the edge zones of the hood. The space which is surrounded by the shielding element is expediently exposed to vacuum. Further, by virtue of the cylindrical shape of the shielding element, the flow-dynamic characteristics of the air current generated by the rapidly rotating coiler head assembly are improved and rendered more uniform.

BRIEF DESCRIPTION OF THE DRAWING

FIG. 2*a* is a schematic axial side elevational view of another preferred embodiment of the invention, shown in a closed position.

FIG. 2*b* is a view similar to FIG. 2*a*, illustrating the structure in an open position.

FIG. 3 is an axial sectional view of a further preferred embodiment of a component according to the invention.

FIG. 4 is a schematic side elevational view of a preferred embodiment of a further component forming part of the invention.

DESCRIPTION OF THE PREFERRED EMBODIMENTS

Figure 1:
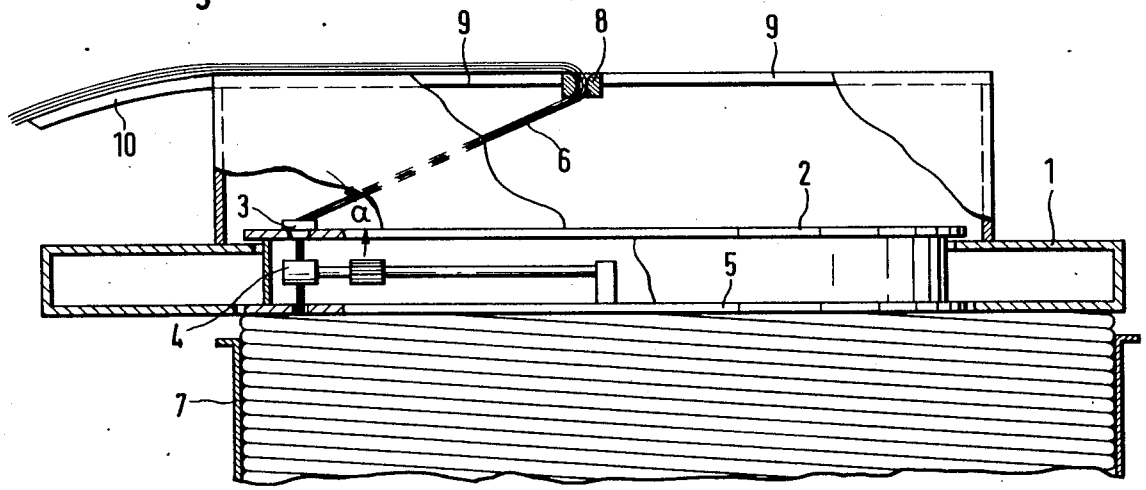
FIG. 1 is a schematic sectional side elevational view of a preferred embodiment of the invention.

Turning to FIG. 1, there is illustrated therein a sliver coiler arranged at the output end of a carding machine (not shown) which delivers a fiber sliver 6. The sliver coiler has a stationary head support plate assembly 1 in which a rotary head assembly 2 is mounted. The latter carries a trumpet 3, supply rollers (calender rollers) 4 and a pressing plate 5 whose underside is substantially coplanar with that of the head supporting plate assembly 1.

During normal operation, the calender rollers 4 are driven such that the sliver 6 which is admitted to the rotary head assembly 2 by passing through the trumpet 3, is deposited in a coiler can 7 which is arranged underneath the head support plate assembly 1 and the rotary head assembly 2. The coiler can 7 rotates as the sliver 6 is deposited by the rotary head assembly 2. The sliver coils deposited in the coiler can 7 project upwardly beyond the upper edge of the coiler can 7 and thus engage the planar undersides of the head support plate assembly 2 and the pressing plate 5 during the major part of the can filling operation and after the completion thereof.

Also referring to FIG. 3, generally centrally above the rotary head assembly 2 there is provided a trumpet-like guide element 8 which has the shape of two back-to-back arranged funnels and which is fixedly mounted on a holding element 9. Upstream of the guide element 8 - as viewed in the direction of sliver run - there is provided a further sliver support element 10 which may be, for example, a sheet metal tray. The sliver, delivered by the carding machine, runs on the slightly bent, substantially horizontally oriented sliver support 10 to the guide element 8 where it enters its funnel-like opening 8*a*, passes through the constriction 8*b* and exits the guide element 8 through the outwardly flaring funnel-like outlet opening 8*c* in the downward direction and is deflected towards the sliver trumpet 3. The angle formed by a straight line connecting the center of the outlet 8c of the guide element 8 with the center of the inlet of the trumpet 3, with the generally horizontal plane in which the rotary head assembly 2 rotates is approximately 30°. This geometrical arrangement ensures that the sliver 6 is guided at a small (flat) angle from the guide element 8 to the trumpet 3 relative to the plane in which the rotary head assembly 2 revolves, whereby the centrifugal forces generated by the rotation of the head assembly 2 have a significantly reduced effect on the sliver 6.

As the sliver passes through the constriction 8*b* of the guide element 8 air is expelled by compression from the sliver 6 whereby the latter is precompressed and thus made more stable and less prone to rupture.

Turning now to the embodiment illustrated in FIGS. 2*a* and 2*b*, above the head support plate assembly 1 there is provided a hood or box 11 which has an upper lid or ceiling wall 11*a*. In a lateral wall of the hood 11 there is provided an aperture 11*b* through which the sliver 6, as it is guided on a roller 12, is introduced in the inner space of the hood 11. In addition, as indicated by the arrow A, air is entrained into the inner space of the hood 11. In the lateral zone of the hood 11 there is further provided an aperture 11*c* to which there is connected a suction device (not shown) for removing air as indicated by the arrow B. In the inside of the hood 11 the guide element 8 is arranged above the rotary head assembly 2. The lid 11*a* of the hood 11 is upwardly pivotal about a hinge 11*d* as illustrated by the arrow D in FIG. 2*b*. In the upwardly pivoted position of the lid 11*a* an easy manual access is provided, particularly for the purpose of facilitating the manual insertion of the sliver 6 into the guide element 8 and the trumpet 3 for the start-up operation.

Reverting to FIG. 3, in the guide element wall defining the inlet portion 8*a* of the guide element 8 there is provided a recess 8*d* through which air is removed as it flows in the upstream direction after being expelled from the sliver as it passes through the constriction 8*b*. The constriction 8*b* may be of slighter greater diameter than the inlet of the sliver trumpet 3 whereby a pre-densification of the sliver 6 is effected by the guide element 8.

According to the embodiment illustrated in FIG. 4, upstream of the trumpet-like guide element 8 a sliver supporting plate 10' is arranged which has a shingle-like (stepped) surface 10*a*. By virtue of this arrangement, the sliver running on the plate 10' towards the guide element 8 rides on an air cushion.

Figure 5:
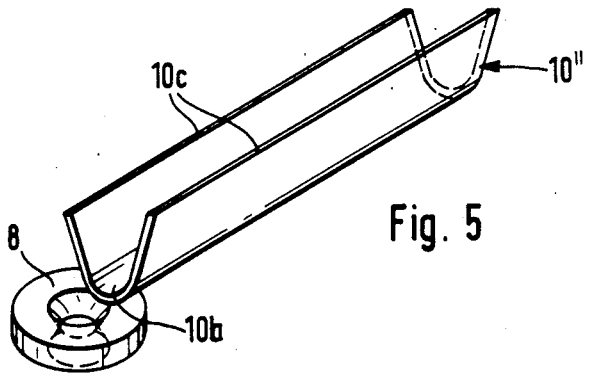
FIG. 5 is a schematic perspective view of another preferred embodiment of a component of the invention.

According to the embodiment of FIG. 5, the sliver support situated upstream of the guide element 8 is constituted by a trough 10'' which has a bottom face 10*b* and two lateral guide walls 10*c*.

Figure 6:
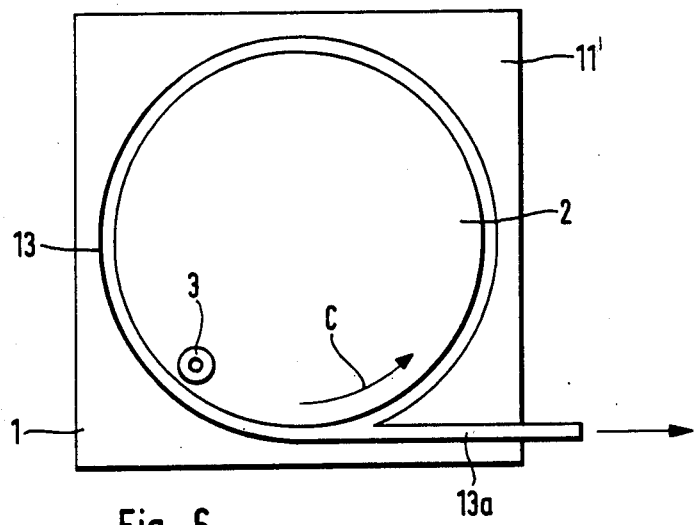
FIG. 6 is a top plan view of the structure shown in FIG. 2*a*, illustrating a preferred embodiment of a further component of the invention.

Turning now to FIG. 6, the rotary head assembly 2-whose rotary direction is indicated by the arrow C-is mounted in an angular hood or box 11'. About the rotary head assembly 2 in the inner space of the box 11' there is provided a stationary, circularly bent shielding element 13 which may be of sheet metal and which is in an upright, edgewise standing position on the head support plate assembly 1. The shield 13 is provided with a suction nipple 13*a* for removing dust or other waste.

It will be understood that the above description of the present invention is susceptible to various modifications, changes and adaptations, and the same are intended to be comprehended within the meaning and range of equivalents of the appended claims.

What is claimed is:

1. In a sliver coiler including a unidirectionally rotating rotary head assembly having a radius and a generally horizontal plane of rotation; a sliver trumpet eccentrically mounted in the rotary head assembly and a sliver supporting means including a fixedly held, immovable sliver guide element situated centrally above said rotary head assembly at a distance therefrom; the sliver having an unsupported running portion extending through a free space linearly from said sliver guide element to said sliver trumpet; the improvement wherein the angle formed between said plane of rotation and a line connecting said sliver guide element with said sliver trumpet is 30° at the most, permitting high running speeds of the sliver.

2. A sliver coiler as defined in claim 1, wherein said distance is, at the most, equal to said diameter.

3. A sliver coiler as defined in claim 1, wherein said sliver guide element has a wall face of trumpet-like shape for guiding said sliver therethrough.

4. A sliver coiler as defined in claim 3, wherein said wall face has a tapering inlet portion, a constriction and a flaring outlet portion; further comprising a recess provided in said inlet portion.

5. A sliver coiler as defined in claim 1, wherein said sliver guide element is a first sliver guide element and further wherein said sliver supporting means comprises a second sliver guide element disposed upstream of said first guide element as viewed in a direction of sliver run.

6. A sliver coiler as defined in claim 5, wherein said second sliver guide element comprises a trough.

7. A sliver coiler as defined in claim 5, wherein said second sliver guide element comprises a backup plate having a shingle-like length portion.

8. A sliver coiler as defined in claim 1, further comprising a hood extending above said rotary head assembly.

9. A sliver coiler as defined in claim 8, wherein said sliver guide element is situated within said hood.

10. A sliver coiler as defined in claim 9, further comprising suction means connected to said hood.

11. A sliver coiler as defined in claim 8, wherein said hood has a lid pivotally attached to said hood for swinging towards and away therefrom into respective closed and open positions.

12. A sliver coiler as defined in claim 8, further comprising a circularly bent stationary shielding element arranged within said hood about said rotary head assembly.

* * * * *